United States Patent [19]

Hebert

[11] 4,085,495

[45] Apr. 25, 1978

[54] METHOD OF ERECTING FORMS FOR A CONCRETE FORM

[76] Inventor: Napoleon R. Hebert, 2301 I St., NE., Auburn, Wash. 98002

[21] Appl. No.: 729,023

[22] Filed: Oct. 4, 1976

[51] Int. Cl.[2] ..... B23P 21/00

[52] U.S. Cl. ..... 29/469; 29/525; 29/526 R; 249/191; 249/192; 249/219 W

[58] Field of Search ..... 29/452, 469, 525, 526, 249/191, 192, 219 W

[56] References Cited

U.S. PATENT DOCUMENTS

| | | | |
|---|---|---|---|
| 2,882,583 | 4/1959 | Arrighini et al. | 249/192 X |
| 3,360,232 | 12/1967 | Vandenheuvel | 249/191 |
| 3,436,053 | 4/1969 | Person et al. | 249/192 |
| 3,547,398 | 12/1970 | Furr | 249/219 W |
| 3,730,476 | 5/1973 | Prichard | 249/191 |
| 3,767,158 | 10/1973 | Mikus | 249/192 |
| 3,977,647 | 8/1976 | Williams | 249/191 |

*Primary Examiner*—Charlie T. Moon
*Attorney, Agent, or Firm*—Robert B. Hughes

[57] ABSTRACT

Providing vertically erect sets of oppositely positioned forming panels, with the sets being interconnected by means of tie rods and wedging plates. Some of the wedging plates are positioned adjacent to edge portions of their related panels so as to form an overlap between abutting panels and thus provide support therebetween. In providing a form of greater height where sets of panels are placed one on top of another, a first wall of such panels is provided in two vertical sets, with vertical walers bracing vertically aligned panels, and overlapping wedging plates providing proper alignment and connection between laterally adjacent panels. An opposite wall made up of two sets of panels is provided in a similar manner, but with a horizontal waler or walers providing for support and alignment.

12 Claims, 14 Drawing Figures

FIG. 6A
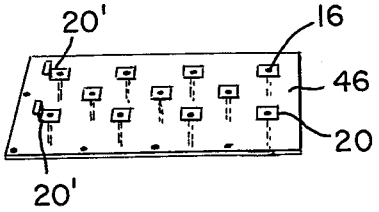
FIG. 6B
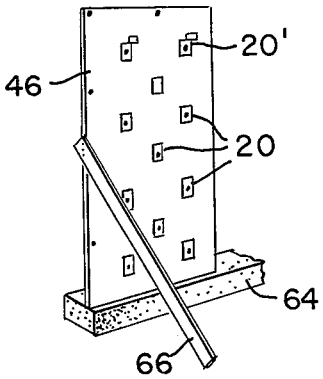
FIG. 6C
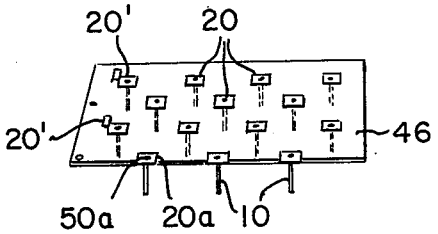
FIG. 6D
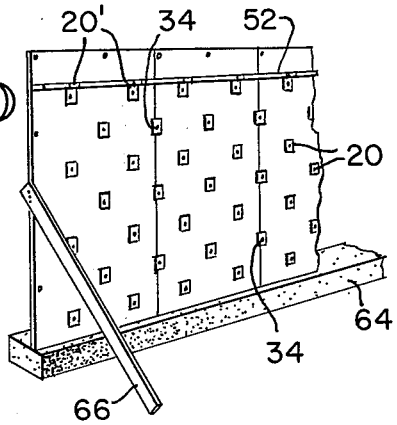
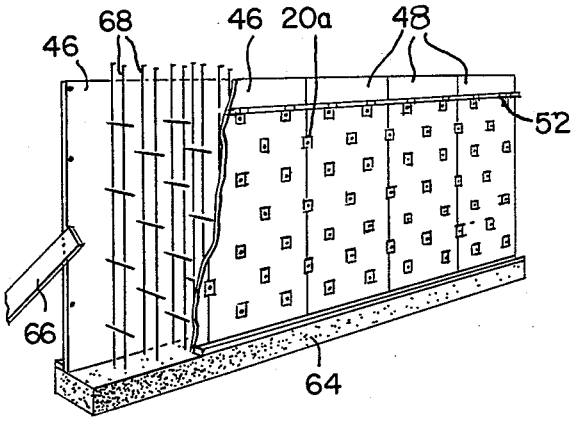
FIG. 6E
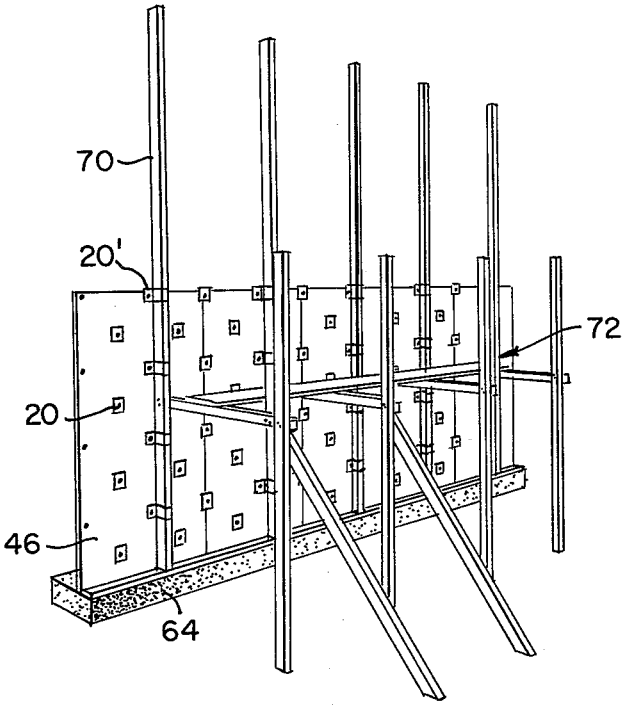
FIG. 7A

METHOD OF ERECTING FORMS FOR A CONCRETE FORM

BACKGROUND OF THE INVENTION

1. Field of the Invention

The present invention relates to a method and apparatus for erection of a form for pouring a concrete wall.

2. Brief Description of the Prior Art

A common prior art method of providing a form for pouring a concrete wall utilizes as the main components: (a) rectangular forming panels with spaced through holes, (b) tie rods which fit through the panel holes and interconnect oppositely positioned panels, (c) wedging plates which hold the two ends of the tie rods securely to the panels, (d) waler brackets, which often serve the dual function of a wedging plate and a bracket for carrying a waler, (e) one or more walers which provide structural reinforcement and keep adjacent panels in proper alignment, and (f) other support structures to keep the assembled form erect.

Usually one wall of the form is erected by placing a plurality of panels in a vertically erect position, aligned with one another in a single plane which defines one surface of the concrete wall which is to be poured. Tie rods are inserted through the holes in each panel, and each tie rod is secured by one end to its related panel by means of a wedging plate or a wedging plate with a waler bracket thereon. As each individual panel is placed in its erect position, it is usually held there either by some sort of scaffolding structure, temporary framework or bracing struts. Walers, usually in the form of long 2 × 4 wooden pieces, are placed along the outer surface of the panels and are held securely in place by the waler brackets.

After one set of panels is assembled and properly braced to form the one wall of the form, the opposite wall of the form is then erected by placing a second set of panels opposite the first set so that the second set of panels fits over the second oppositely positioned ends of the tie rods. Then wedging plates are inserted over the protruding heads of the tie rods and pushed into wedging engagement to hold the second set of panels securely to the tie rods, thus, securing the two opposite sets of panels one to the other. Some of these wedging plates are in the form of waler brackets, and walers are likewise placed against the second set of panels to insure proper alignment and structural reinforcement.

When it is desired to form a wall of greater vertical dimension, requiring sets of panels one on top of another, the task becomes more complex in that more structural reinforcing is required, and usually scaffolding or the like, to hold the panels and other components in place and provide access to the upper sets of panels by the workmen. In such an operation, usually the first set of panels is erected in much the same manner as disclosed above, with horizontal walers holding the panels in alignment. Then a temporary scaffolding is erected, after which a second set of panels is placed on top of the first set in planar alignment therewith. Support for this second upper set of panels is usually provided by the scaffolding, and horizontal walers are then placed against the upper second set of panels. Then quite often a set of vertical walers or studs is placed against the horizontal walers to provide for proper alignment between the upper and lower sets of panels and also provide structural reinforcement. After this, a second two sets of panels are erected opposite the first two sets in somewhat the same manner as described above.

In a competitive industry such as the construction industry, as expected, there have been many attempts to make improvements in this system, and a number of patents have made various improvements in the configuration of the waler brackets themselves. For example, U.S. Pat. No. 2,977,659, Buxton, discloses a waler bracket which is pivotally attached to either a tie rod or a wedging plate. Other examples of modified forms of waler brackets are disclosed in the following U.S. Pat. Nos. 3,030,059, Jahn; 3,241,803, Foy; 3,286,976, Lynch; 3,047,264, Terry; 3,547,398, Furr; and 3,729,159, Foster.

In most of these prior art patents noted above, the waler bracket serves its conventional function of providing a bracket to carry the waler and it is usually placed in wedging engagement in some manner with the tie rod. The modifications are usually made to obtain such advantages as greater durability, better application of pressure against the associated panel, ease of installation and removal after the concrete pour has been completed, etc.

There have been other efforts to make various improvements in the tie rods and examples of these are disclosed in U.S. Pat. No. 3,785,610, Dagiel, and U.S. Pat. No. 3,075,272, Buyken.

U.S. Pat. No. 3,327,986, Oury, shows a more comprehensive system for erecting forms for concrete walls. Abutting panels are joined one to another by plates which extend between two panels with projecting studs or pins extending into the panels. Each plate is then secured by means of a "hairpin" which is placed in wedging engagement with the plate to cause it to be in firm engagement with the panels. To engage a waler or a "kicker bracer", U-shaped brackets are provided, and L-shaped brackets are adjustably and rotatably mounted on modified hairpin brackets either for walers or catwalks. While the system in the Oury patent may provide certain advantages in convenience of erection of the forms, it does require more sophisticated hardware than is normally used.

Even though there have been many specific hardware improvements in the apparatus required to erect forms for pouring concrete walls, one of the major expenses still remains the considerable labor involved not only in erecting and securing the forms themselves, but also in erecting bracing and scaffolding. A further labor cost is the installation of a substantial number of walers, and in the case of forms requiring upper and lower sets of panels, the placing of vertical studs or walers over the horizontal walers.

Accordingly, it is an object of the present invention to provide a system for erecting forms for pouring concrete walls, which system eliminates some of the labor involved in erecting such forms and utilizes hardware of a relatively simple and easily workable nature.

SUMMARY OF THE INVENTION

In the method of the present invention, the form for pouring a concrete wall is erected by first providing a plurality of panels having through holes therein at spaced locations over the panel, with some of these holes being "edge holes" located closely adjacent edge portions of its related panel at a predetermined edge distance therefrom. In each hole, there is inserted one end of a tie rod, and this is secured by placing a wedging plate against an outer surface of the panel and engaging the protruding end of the tie rod in secure wedging relationship in the slotted opening of the related wedging plate. Then a first panel is placed in a vertically erect position and braced in that position, as by use of a wooden 2 × 4 extending from a ground location and being nailed to an edge of the panel.

Then a second panel is erected adjacent the first panel in planar alignment therewith, and secured to the first panel by means of the wedging plates secured to tie rods in the edge holes of one of the two panels. This fastening of the first and second panels is made possible since the position of the edge hole is selected relative to the wedging plates, so that the edge dimension of the hole (i.e., the distance from the hole to the edge of the panel) is less than at least one lateral dimension of at least some of the wedging plates, which lateral dimension is measured from the slotted opening of the wedging plate to the edge of the plate. With this arrangement, at least some of the wedging plates extend beyond the adjacent edge portion of its panel to provide an overlapping plate portion which extends over the second panel. In the preferred form, the overlapping plate portion is provided with a through opening, through which a nail or other fastener can be inserted, at least temporarily, to retain the second panel in its vertically erect position.

Thereafter other panels can be placed in side by side edge abutment, with each subsequent panel obtaining support from the panel previously placed in its vertically erect position. At various locations, additional bracing can be provided as needed.

To complete the form, a second set of panels is positioned opposite the first set so that the opposite ends of the tie rods extend through holes in the other panels. The ends of the tie rods extending through the second set of panels are similarly engaged with wedging plates to secure the second set of panels to the first set. At least some of the wedging plates mounted to the panels are provided with waler brackets so that one or more horizontal walers can be placed against the panels at the open faces thereof to provide additional structural support and insure proper alignment.

To provide forming walls of a greater vertical dimension, where two sets of panels are positioned one above the other to form a single wall, a modified procedure is used. A first set of forming panels is placed in a vertically erect position and secured one to another, in much the same manner as described above. However, the wedging plates having waler brackets are aligned so that they are able to engage vertical walers or studs. Scaffolding is erected to give workmen access to the area above the presently erected lower wall portion, and a second set of panels is placed above the first set in planar alignment therewith and secured in place by means of vertical walers previously positioned in the waler brackets on the lower set of panels. Because of the overlapping arrangement of wedging plates at the edge portions of the panels, it is ordinarily not necessary to provide horizontal walers for the wall first erected with the upper and lower sets of panels. After the first wall is erected, reinforcing steel is usually placed in the area where the wall is to be poured after the erection of the first wall, but prior to the erection of the second wall.

The opposite wall is erected in somewhat the same manner as in the first described embodiment, with a third set of panels being placed opposite the first set over the outwardly extending ends of the tie rods, and secured in place by means of wedging plates.

A fourth set of panels is then also erected, in much the same manner as previously described, directly above the third set. The wedging plates having waler brackets thereon are then oriented to accept one or more horizontal walers which are then put in place along the outside surface of the second wall.

In the apparatus that is erected according to the system of the present invention, there are at least two sets of forming panels, forming first and second walls, with the panels of each set being positioned vertically erect in edge of edge abutting relationship in the same vertical plane. The panels are provided with edge holes, each having a first predetermined edge distance from the edge portion of its related panel. Wedging plates are in wedging engagement with tie rods extending through such edge holes, with a lateral dimension of at least some of the wedging plates (measured from a slotted opening thereof to the edge of the plate) being greater than the edge distance of its related panel edge opening. Thus, at least some of the wedging plates extend beyond the adjacent edge portion of its related panel, to provide an overlapping plate portion to engage the adjacent panel. Also, the wedging plate is provided with a fastening means at its overlapping portion, which in the preferred embodiment is simply a through hole to receive a fastener, such as a nail. This provides for positive interconnection between adjacent panels.

In an assembled apparatus for pouring a concrete wall of a greater vertical dimension, where there are two walls each having at least two sets of panels, one above the other, there are overlapping edge wedging plates, as indicated above, and also edge wedging plates which overlap between upper and lower panels and at corners of panels. In the preferred form, it has been found adequate to provide only vertical walers on one of the walls, and one or more horizontal walers on the other. This arrangement of walers, along with the structural and alignment support provided by the wedging plates has been found adequate for pouring concrete walls in the usual type of construction operation.

The individual panels of the present invention have a generally planar, rectangular configuration, with through holes at spaced locations over at least a substantial portion of the panel surface. In addition, some of these holes are placed closely adjacent an edge portion of the panel by a predetermined edge distance. The associated wedging plate has a generally rectangular planar configuration, with a centrally located elongate protrusion or boss, in which is formed a keyhole shaped wedging slot. The lateral dimension of the wedging plate, measured from the wedging slot to the edge of the plate, is greater than the edge distances of edge holes in the related panels. As indicated above, this enables the wedging plates to be placed in overlapping relationship between adjacent panels. Additionally, in the preferred form, an overlapping portion of each wedging plate is provided with a means for fastening the overlapping portion to an adjacent panel, this being conveniently provided simply by means of a through hole, into which a fastener, such as a nail, could be inserted. Some of the wedging plates are formed at the upper end thereof with an integral laterally extending L-shaped bracket member so that such wedging plates can serve as a waler bracket.

Other particular features of the invention will become apparent from the following detailed description.

BRIEF DESCRIPTION OF THE DRAWINGS

FIGS. 6A through 6E are a series of figures illustrating the steps of the first embodiment of the method of the present invention;

FIGS. 7A through 7C are a series of figures showing the steps of a second embodiment of the method of the present invention, where a form of a greater vertical dimension is erected, with two sets of panels one above the other for each forming wall.

DESCRIPTION OF THE PREFERRED EMBODIMENTS

Figure 1:
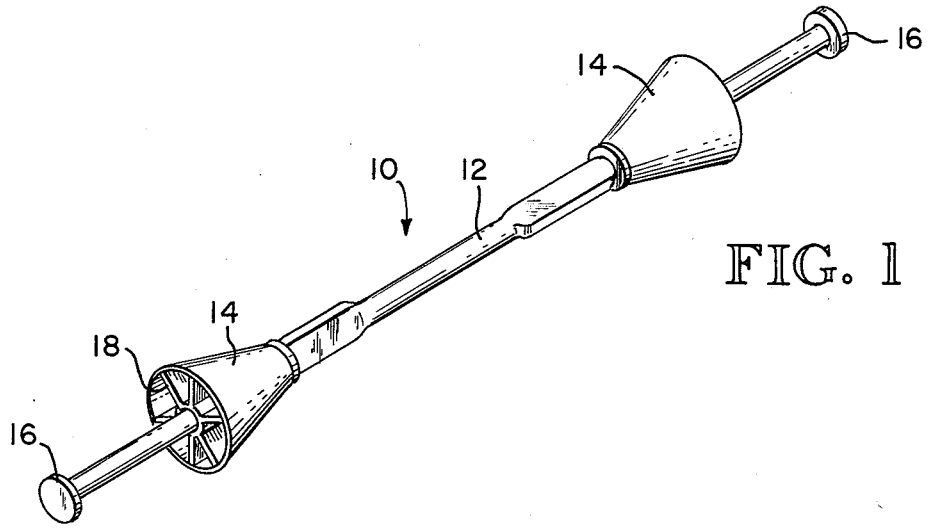
FIG. 1 is a perspective view of a conventional tie rod used in the system of the present invention.
Figure 2:
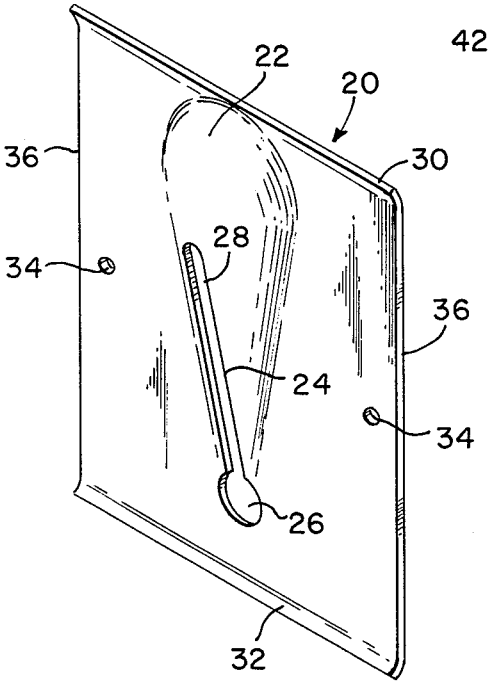
FIG. 2 is a perspective view of a wedging plate particularly adapted for use in the system of the present invention.
Figure 3:
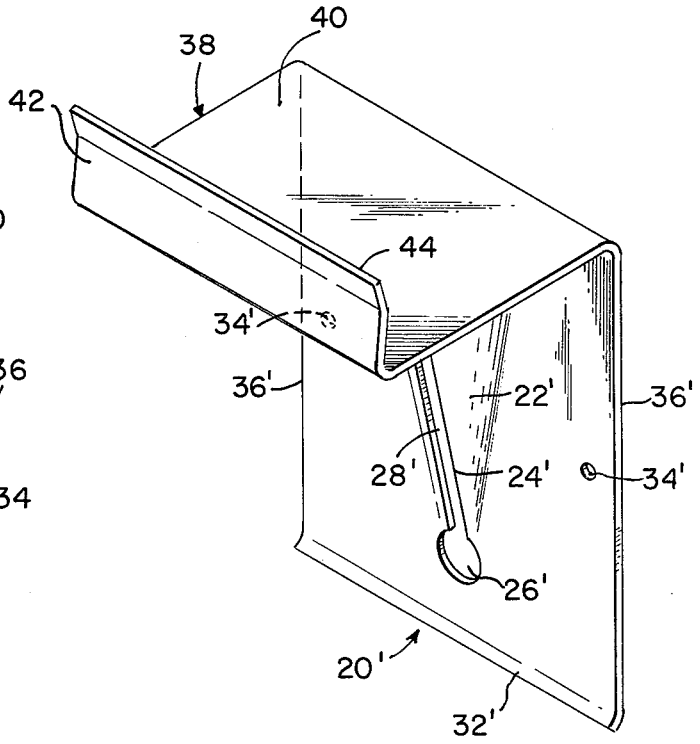
FIG. 3 is a perspective view similar to FIG. 2, showing a wedging plate of the present invention formed as a waler bracket.

FIGS. 1 through 3 show the main hardware components of the present invention. In FIG. 1, there is shown a tie rod 10 which is or may be of conventional configuration. It comprises a main body or shank 12, two expanded spacing elements 14 and two end head portions 16. The two spacing elements 14 have outwardly facing contact surfaces 18 to engage the inner surfaces of two oppositely positioned panels to hold them in properly spaced relationship. Each head portion 16 is expanded at its outer end to engage a related wedging slot of an associated wedging plate.

In FIG. 2, there is shown a wedging plate 20 particularly adapted for use in the present invention. The plate 20 has a generally planar rectangular configuration, with an elongate middle protrusion or embossment 22 which slants away from the plane of the plate 20 in an upward direction. In the embossment 22 there is a keyhole opening 24 having a lower enlarged portion 26 lying in the plane of the plate 20, and an upper slotted portion 28 which slants away from the plane of the plate 20. The upper and lower edges 30 and 32, respectively, of the plate 20 are flared outwardly to a moderate extent so that the plate could be more easily engaged or impacted to be moved into or out of wedging engagement.

At each of the lateral edge portions of the plate 20, there is a through hole 34 capable of receiving a fastener such as a nail. The overall lateral dimensions of the plate 20 are of significance in the present invention, particularly the dimension from the opening 24 to the lateral edge portions 36, and also the dimension from the opening 24 to the fastener opening 34.

In FIG. 3, there is shown a second wedging plate 20' which is similar to the first described wedging plate 20, except that a waler bracket is added and made integral with the plate 20'. Components of this second wedging plate 20', similar to those of the first wedging plate 20, are given like numerical designations, with a prime (') designation distinguishing those of the second type of wedging plate. Thus the wedging plate 20' has the embossment 22' with the wedging opening 24', made up of the enlarged portion 26' and slot opening 28'. It has a flared lip 32' at its lower end and edge fastening holes 34' adjacent the lateral edge portions 36'. The upper edge of the plate 20' has an outwardly extending L-shapes bracket portion 38 comprising a horizontal plate 40 and an upstanding flange 42. This L-shaped portion 38 serves as a waler bracket, and the upper end of the flange 42 is flared outwardly to a moderate extent, as at 44 to facilitate insertion of a waler into the L-shaped bracket 38 to fit snugly against the flange 42 and against the plate portion 40.

Figure 4:
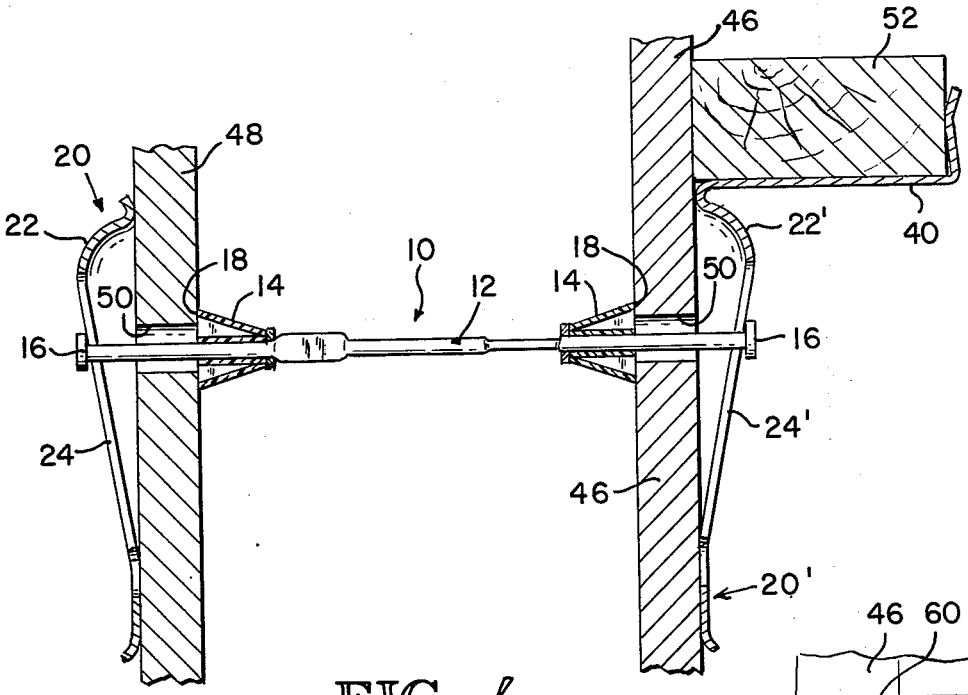
FIG. 4 is a sectional view through a portion of an assembled form for a vertical concrete wall, showing the assembly of a tie rod, wedging plate, and a second wedging plate with a waler bracket engaging a waler, with these components holding two oppositely positioned panels in proper spaced relationship.

FIG. 4 illustrates the manner is which the hardware components of FIGS. 1 through 3 are assembled to make a single tie between two opposed forming panels 46 and 48. It can be seen that the two head portions 16 of the tie rod 10 extend through oppositely positioned holes 50 in the two panels 46 and 48, with one head portion 16 extending through the slot-like opening 24 and in wedging engagement with the embossment 22 of the plate 20. The opposite head portion 16 of the tie rod 10 is in similar wedging engagement with the embossment 22' of the waler bracket wedge plate 20'. The two spacing elements 14 bear against each of the panels 46 and 48. A conventional waler 52 is positioned within the L-shaped bracket 40 to bear against the panel 46. This particular tying arrangement of the tie rod 10 and the wedging engagement of the shoes 20 and 20' is, in and of itself, old in the prior art, but is used in the system of the present invention in a particular manner to provide certain distinct advantages.

Figure 5A:
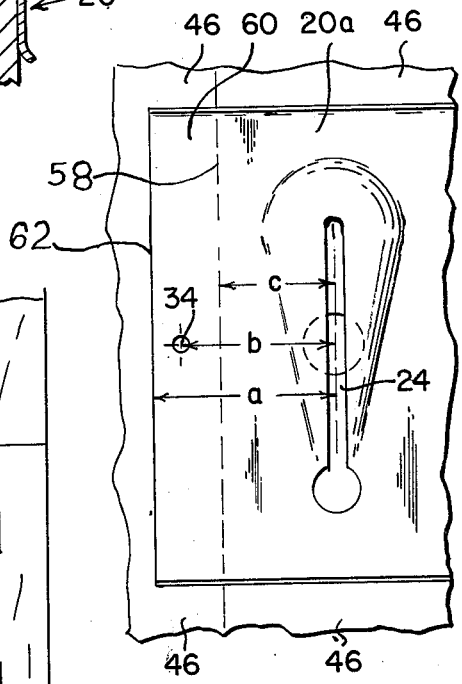
FIG. 5A is an enlarged view of one wedging plate adjacent an edge of a related panel.
Figure 5:
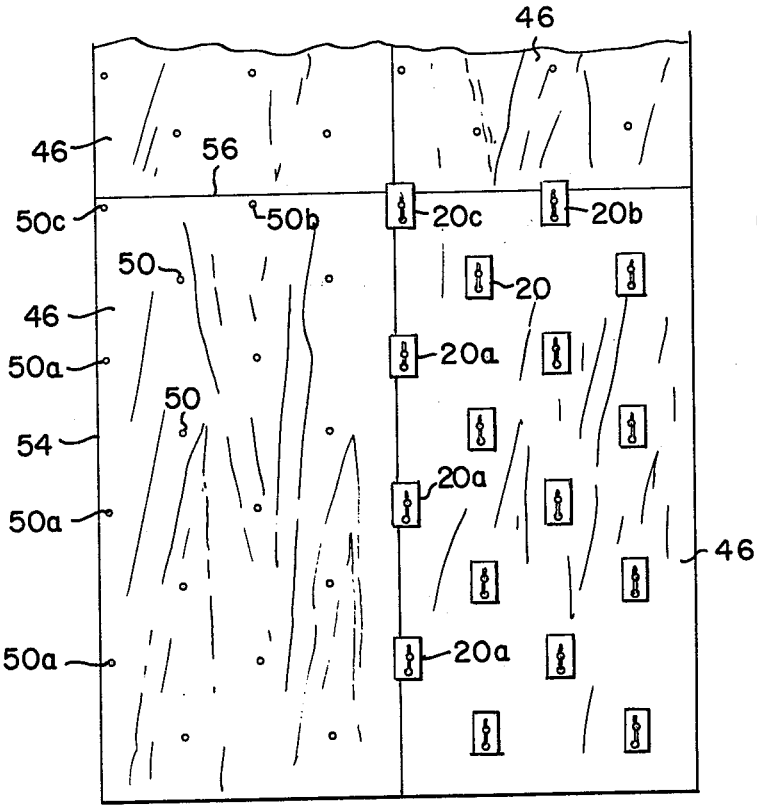
FIG. 5 is a front elevational view of the outside surface of a portion of one wall of the assembled apparatus in the system of the present invention.

FIG. 5 shows one portion of a wall of a form erected according to the present invention. There are shown two lower panels 46, positioned vertically erect in edge abutment and two upper panels 46 positioned directly above the other two panels 46, with all four panels positioned in the same vertical plane. For purposes of illustration, wedging plates 20 have been shown as being applied to only the lower right hand panel 46.

It will be noted that each panel 46 has a plurality of through holes 50 at regularly spaced locations over substantially the entire surface of the panel 46. Three of these holes **50*a* are lateral edge holes and are positioned quite closely (e.g., within 1 ½ inches) to an adjacent lateral edge 54 of the panel 46. There is one upper edge hole 50*b* adjacent the upper vertical edge 56 of the panel 46 and one corner edge hole 50*c* positioned very closely to both the upper and lateral edge 54 and 56**.

As shown in FIG. 5, 11 wedging plates 20 have been placed in wedging engagements with tie rods which have been positioned in the holes 50 which are more centrally located in the lower right hand panel 46. There are three wedging plates **20*a* which are positioned in engagement with tie rods 10 extending through the lateral edge holes 50*a*; one wedging plate 20*b* in engagement with a tie rod 10 extending through the upper edge hole 50*b*; and one wedging plate 20*c* which is in engagement with a tie rod 10 extending through the corner edge hole 50*c*. It will be noted that the wedging plates 20*a* are in overlapping relationship with the lower left hand panel 46, the wedging plate 20*b* is in overlapping relationship with the upper right hand panel 46, and the corner wedging plate 20*c* is mounted to the lower right hand panel 46 and is in overlapping relationship with all of the other three panels 46**.

FIG. 5A shows one of the lateral edge wedging plates 20*a* drawn to an enlarged scale. The abutment line of the two panels 46 is indicated at 58, and it can be seen that the wedging plate 20*a* has an overlapping edge portion 60 which extends beyond the juncture of line 58. Likewise, the fastening hole 34 extends beyond the junction line 58. This relationship is accomplished by making a lateral dimension of the wedging plate 20*a*, measured from the slot 24 to the lateral edge 62 (this dimension designated "*a*" in FIG. 5A) and also the dimension from the slot-like opening 24 to the fastening hole 34 (designated "*b*" in FIG. 5A), both larger than the dimension from the lateral edge hole 50*a* to the lateral edge 54 of the panel 46 (this dimension designated "*c*" in FIG. 5A). This same dimensional relationship applies to the lateral dimension of the upper wedging plates 20*b*, so that the upper and corner positioned plates 20*b* and 20*c* have a similar overlapping relationship with their adjacent panels 46.

A first embodiment of the method of the present invention is illustrated in FIGS. 6A through 6E, where there is shown a form for a concrete wall having a vertical dimension no greater than the length-wise dimension of one of the panels 46.

In FIG. 6A, a first panel 46 has the ends 16 of a number of tie rods 10 placed in its holes 50, and wedging plates 20 are placed in wedging engagement with the tie rods' heads 16. At two laterally spaced locations, waler bracket wedging plates 20' are provided and positioned in a manner to receive a horizontally disposed waler.

As shown in FIG. 6B, this first panel 46 is placed in a vertically erect position on a previously poured concrete footing 64, and held in that position by suitable means, such as a kicker brace shown as 66. As shown in FIG. 6C, a second panel 46 is provided with tie rods 10 secured to the panel 46 be means of wedging plates 20 and 20'. Additionally, three of the wedging plates 20 are positioned at lateral edge holes 50*a* of the sheet 46 so as to become laterally overlapping wedging plates 20*a*.

Then, as shown in FIG. 6D, the second panel 46 is placed in a vertically erect position adjacent the first panel 46 and in planar alignment therewith in edge abutting relationship. Thus, the edge positioned wedging plates 20*a* of the second panel 46 come in overlapping relationship with the adjacent edge portion of the first panel 46. The two panels 46 are then secured one to another by simply pounding a nail through the hole 34 and into the adjacent panel 46. Additional panels 46 can be erected and secured in like manner, after which one or more walers 52 are then inserted in engagement with the waler bracket wedging plates 20'.

As shown in FIG. 6E, after the first wall, made up of panels 46, is erected, then a second set of panels 48 is positioned to made the other wall of the form. Prior to erecting the second set of panels 48, quite commonly reinforcing steel is placed in the area where the concrete wall is to be poured, a portion of such reinforcing steel being indicated at 68 in FIG. 6E. Panels 48 of the second set are placed in a vertically erect position by aligning the holes 50 of such panels with the outwardly extending ends of the tie rods 10, and then placing wedging plates 20 over the ends 16 of the tie rods 10 protruding through the panels 48. As with the first set of panels 46, some of the wedging plates 20 are provided in the form of waler bracket wedging plates 20', after which one or more horizontal walers 52 are inserted to provide structural and alignment reinforcement. In some instances, it is possible to use only one horizontal waler against only one of the sets of panels 46.

With the apparatus so assembled, by completing the steps indicated in 6E, the form is now ready for a concrete pour. Additional bracing or reinforcing would be needed primarily to insure that the form remains vertical during the pour. The overlapping relationship of the edge-positioned wedging plates 20*a* provides support between the panels 46 and 48 so that walers 52 are required at much less frequent intervals than in the prior art.

Figure 7B:
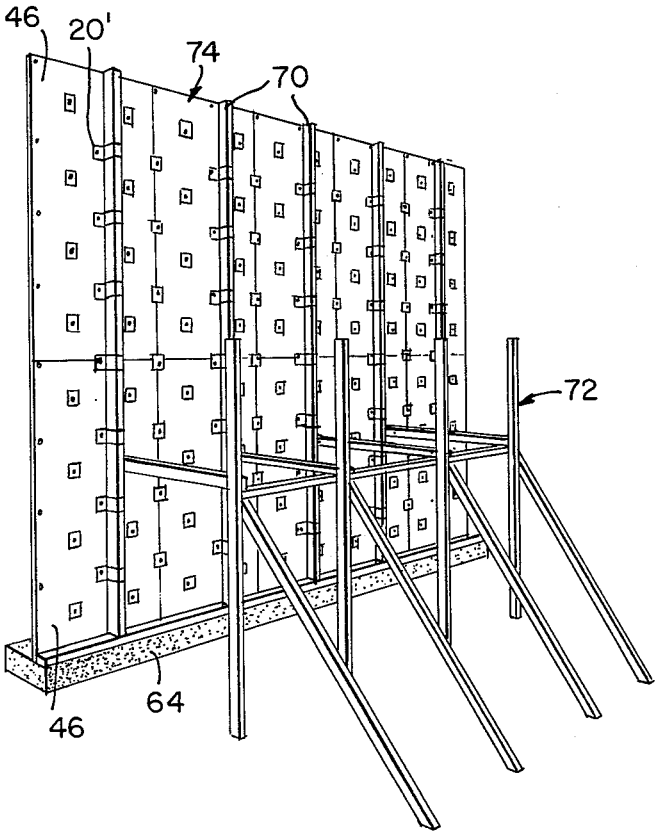
Figure 7C:
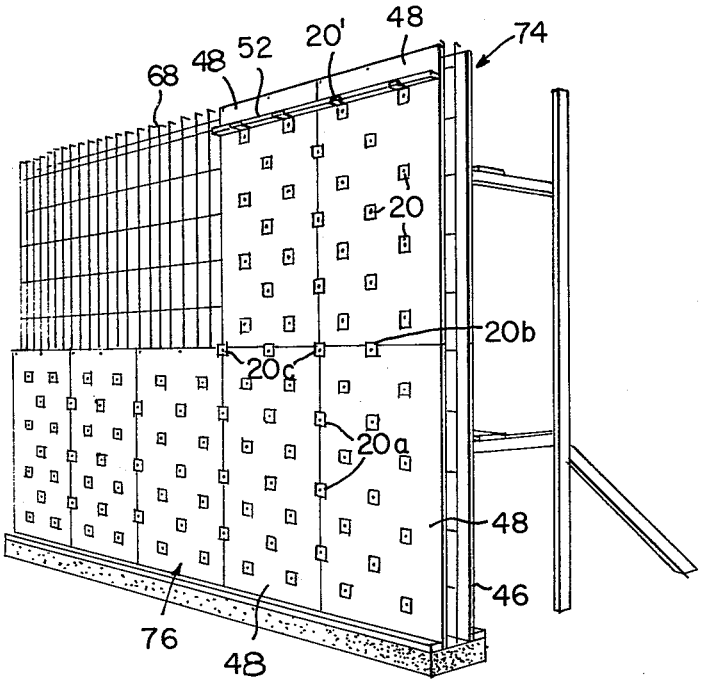

A second embodiment of the method of the present invention is shown in FIGS. 7A through 7C. In FIG. 7A, there is shown in first lower set of panels 46 erected in much the same manner as the panels 46 in the first embodiment of FIG. 6A through 6E. However, instead of placing the waler bracket wedging plates 20' in horizontal alignment, these plates 20' are placed in vertical alignment for each panel 46. After the first set of lower panels 46 has been erected, then vertical walers 70 are positioned in engagement with the bracket portions 38 of the wedging plates 20', with these vertical walers 70 extending a substantial distance above the first set of panels 46. Then scaffolding is provided as at 72, to provide access for workmen to the area above the lower set of panels 46.

Then, as shown in FIG. 7B, a second upper set of panels 46 is provided with wedging plates 20 and 20' in engagement with tie rods 10 in the same manner as described before, and these are positioned above the first row of panels 46 in the same vertical plane therewith. The upper portion of the vertical waler 70 is in engagement with the waler bracket wedging plates 20' to provide reinforcement between each pair of upper and lower panels 46. The laterally overlapping wedging plates 20*a*, the upper overlapping wedging plates 20*b*, and the corner wedging plates 20*c* provide for structural and alignment reinforcement between the panels 46 of the first wall 74 formed thereby.

As shown in FIG. 7C, reinforcing steel 68 is put in place, and two second sets of panels 48 are placed opposite the first sets of panels 46. This is done in substantially the same manner as described in the first embodiment, and it will be noted that the waler bracket wedging plates 20' are horizontally aligned for the upper set of panels 48 to permit the placement of an upper horizontal waler for the upper set of panels 48. In some instances, it may be desirable to use also a second lower horizontal waler 52 for the lower set of panels 48, but usually this is not necessary. As with the first wall 74, the second wall 76 formed by the second sets of panels 48 is provided with overlapping wedging plates 20*a*, 20*b* and 20*c*, to insure proper alignment and structural reinforcement of the panels 48. It will be noted that with this arrangement of overlapping wedging plates, 20*a*, 20*b* and 20*c*, a structurally sound form for the concrete wall can be provided with only vertical walers 70 on the one wall 74 and only two sets or even one set of horizontal walers 52 on the opposite wall 76. With the second wall 76 being completed and the walers 52 in place, the form is completed and ready for the pouring of the concrete wall.

I claim:

1. A method of erecting a form for a concrete wall, said method comprising:

a. providing a first panel having through holes therein at spaced locations over a substantial portion of the panel, some of which holes are edge holes located proximate edge portions of said panel at a predetermined edge distance therefrom, b. inserting tie rods through said panel holes, each of said tie rods having a spacing element which engages an inner surface of said panel, placing wedging plates against an outer surface of said panel and engaging the rods with the wedging plates in secure wedging relationship in slotted openings in the wedging plates, so that spacing elements of the tie rods firmly engage the inner surface of the panel, c. placing the panel in a vertically erect position and bracing the panel in that position, d. providing a second panel, inserting tie rods therein, each of said tie rods having a spacing element which engages an inner surface of said second panel, and placing wedging plates against the second panel in wedging engagement with the tie rods, so that the spacing elements of the tie rods firmly engage the inner surface of the second panel, e. placing the second panel in a vertically erect position adjacent the first panel, f. at least one lateral dimension of at least one of the wedging plates, measured from the slotted opening of the plate to the edge of the plate being greater than the edge distance of its related panel to thus provide an overlapping portion of the wedging plates to engage the adjacent panel, and g. completing the form by placing a second set of panels opposite the first two panels in spaced relationship therefrom, so that the opposite ends of the tie rods extend through the other panels, with spacing elements on the opposite ends of the tie rods engaging inner surfaces of the second set of panels, engaging the other panels and the opposite ends of the tie rods with wedging plates to secure the other panels to the first and second panels and placing at least one waler mounted in waler brackets with at least some of the wedging plates.

2. The method as recited in claim 1, further comprising securing the first and second panels by providing fastening means at the overlapping portion of the edge wedging plate and securing the edge wedging plate to the adjacent panel.

3. The method as recited in claim 1, wherein said fastening means comprises a fastening hole in the overlapping portion of the wedging plate, and a fastener is inserted through such fastening hole.

4. The method as recited in claim 1, wherein a third set of panels with tie rods having spacing elements thereon and secured by wedging plates is erected over the first set of panels, vertical walers are positioned against pairs of vertically aligned panels of said first and third set, and a fourth set of panels is placed opposite the second set of panels and secured thereto with wedging plates and by spacing elements on said tie rods.

5. The method as recited in claim 4, wherein edge wedging plates are placed in overlapping relationship also between upper and lower panels to provide structural and aligning reinforcement therebetween.

6. The method as recited in claim 5, wherein overlapping corner wedging plates are provided to provide structural and aligning reinforcement between adjacent panels joining at corner locations thereof.

7. The method as recited in claim 4, wherein after a fourth upper set of panels is provided above the second set, at least one horizontal waler is provided on at least one of the second and fourth set of panels to provide structural and aligning reinforcement between laterally adjacent panels.

8. A method of erecting a form for a concrete wall, said method comprising:

a. providing a first panel having through holes therein at spaced locations over a substantial portion of the panel, some of which holes are edge holes located proximate edge portions of said panel at a predetermined edge distance therefrom, b. inserting tie rods through said panel holes, each of said tie rods having a spacing element which engages an inner surface of said panel, placing wedging plates against an outer surface of said panel and engaging the rods with the wedging plates in secure wedging relationship in slotted openings in the wedging plates, so that spacing elements of the tie rods firmly engage the inner surface of the panel, c. placing the panel in a vertically erect position and bracing the panel in that position, d. providing a second panel, inserting tie rods therein, each of said tie rods having a spacing element which engages an inner surface of said second panel, and placing wedging plates against the second panel in wedging engagement with the tie rods, so that the spacing elements of the tie rods firmly engage the inner surface of the second panel, e. placing the second panel in a vertically erect position adjacent the first panel, f. at least one lateral dimension of at least one of the wedging plates, measured from the slotted opening of the plate to the edge of the plate being greater than the edge distance of its related panel to thus provide an overlapping portion of the wedging plates to engage the adjacent panel, g. providing a second set of panels, similar to the set of first and second panels, inserting tie rods therein, said tie rods having spacing elements engaging inner surfaces of said second set of panels, placing wedging plates in wedging engagement with the tie rods, so that the spacing elements of the tie rods firmly engage the inner surfaces of the second set of panels, and placing said second set of panels above the first set, h. wedging plates on at least one of said first and second sets of panels overlapping the vertically adjacent panels to provide support therebetween, i. placing vertical walers in engagement with sets of vertically aligned panels, and j. completing the form by placing third and fourth sets of panels opposite the first two sets of panels in spaced relationship therefrom, so that the opposite ends of the tie rods extend through the panels of the third and fourth set with spacing elements on the opposite ends of the tie rods engaging inner surfaces of the third and fourth sets of panels, engaging the third and fourth set of panels and the opposite ends of the tie rods with wedging plates to secure the third and fourth set of panels to the first and second set of panels.

9. The method as recited in claim 8, further comprising securing adjacent panels by providing fastening means at the overlapping portion of the edge wedging plates and securing the edge wedging plates to adjacent panels.

10. The method as recited in claim 8, wherein said fastening means comprises fastening holes in the overlapping portion of the wedging plates, and fasteners are inserted through such fastening holes.

11. The method as recited in claim 8, wherein overlapping corner wedging plates are provided to provide structural and aligning reinforcement between adjacent panels joining at corner locations thereof.

12. The method as recited in claim 8, wherein after a fourth upper set of panels is provided above the second set, horizontal walers are provided on at least one of the third and fourth set of panels to provide structural and aligning reinforcement between laterally adjacent panels.

* * * * *